US006502258B1

(12) United States Patent
Mitchell

(10) Patent No.: US 6,502,258 B1
(45) Date of Patent: Jan. 7, 2003

(54) FITTED TOP SHEET

(76) Inventor: Mary J. Mitchell, 23811 Cabrillo Ave., Torrance, CA (US) 90501

( * ) Notice: Subject to any disclaimer, the term of this patent is extended or adjusted under 35 U.S.C. 154(b) by 0 days.

(21) Appl. No.: 09/887,243

(22) Filed: Jun. 22, 2001

(51) Int. Cl.[7] ..... A47G 9/02
(52) U.S. Cl. ..... 5/497
(58) Field of Search ..... 5/497, 485, 499, 5/482

(56) References Cited

U.S. PATENT DOCUMENTS 1,327,824 A * 1/1920 Holland ..... 5/497
1,865,329 A * 6/1932 Mc Horter ..... 5/497
2,151,375 A * 3/1939 De Voe ..... 5/497
3,258,789 A * 7/1966 Banks ..... 5/485
3,654,646 A * 4/1972 McMahon, Jr. ..... 5/485
3,824,640 A * 7/1974 Golden ..... 5/485
4,266,308 A * 5/1981 Shatz ..... 5/497
5,189,744 A * 3/1993 Roberts ..... 5/497
6,041,456 A * 3/2000 Pharr ..... 5/497
6,134,730 A * 10/2000 Evanson ..... 5/499

* cited by examiner

*Primary Examiner*—Alexander Grosz

(57) ABSTRACT

A fitted top sheet for holding a top sheet to a mattress in a more secured manner. The fitted top sheet includes a top sheet having a first edge, a second edge, a third edge and a fourth edge. The first and second edges are opposite edges with respect to each other. The top sheet has an upper surface and a lower surface and comprises a cloth material. A receiving member removably receives a foot of a mattress. The receiving member is attached to the lower surface of the top sheet and positioned adjacent to the first edge.

1 Claim, 4 Drawing Sheets

FITTED TOP SHEET

BACKGROUND OF THE INVENTION

1. Field of the Invention

The present invention relates to sheet devices and more particularly pertains to a new fitted top sheet for holding a top sheet to a mattress in a more secured manner.

2. Description of the Prior Art

The use of sheet devices is known in the prior art. More specifically, sheet devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,027,460; 5,165,128; 4,316,299; 4,308,626; 3,868,735; and U.S. Des. Pat. No. 383.028.

While these devices fulfill their respective, particular objectives and requirements, the aforementioned patents do not disclose a new fitted top sheet. The inventive device includes a top sheet having a first edge, a second edge, a third edge and a fourth edge. The first and second edges are opposite edges with respect to each other. The top sheet has an upper surface and a lower surface and comprises a cloth material. A receiving member removably receives a foot of a mattress. The receiving member is attached to the lower surface of the top sheet and positioned adjacent to the first edge.

In these respects, the fitted top sheet according to the present invention substantially departs from the conventional concepts and designs of the prior art, and in so doing provides an apparatus primarily developed for the purpose of holding a top sheet to a mattress in a more secured manner.

SUMMARY OF THE INVENTION

In view of the foregoing disadvantages inherent in the known types of sheet devices now present in the prior art, the present invention provides a new fitted top sheet construction wherein the same can be utilized for holding a top sheet to a mattress in a more secured manner.

The general purpose of the present invention, which will be described subsequently in greater detail, is to provide a new fitted top sheet apparatus and method which has many of the advantages of the sheet devices mentioned heretofore and many novel features that result in a new fitted top sheet which is not anticipated, rendered obvious, suggested, or even implied by any of the prior art sheet devices, either alone or in any combination thereof.

To attain this, the present invention generally comprises a top sheet having a first edge, a second edge, a third edge and a fourth edge. The first and second edges are opposite edges with respect to each other. The top sheet has an upper surface and a lower surface and comprises a cloth material. A receiving member removably receives a foot of a mattress. The receiving member is attached to the lower surface of the top sheet and positioned adjacent to the first edge.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new fitted top sheet apparatus and method which has many of the advantages of the sheet devices mentioned heretofore and many novel features that result in a new fitted top sheet which is not anticipated, rendered obvious, suggested, or even implied by any of the prior art sheet devices, either alone or in any combination thereof.

It is another object of the present invention to provide a new fitted top sheet which may be easily and efficiently manufactured and marketed.

It is a further object of the present invention to provide a new fitted top sheet which is of a durable and reliable construction.

An even further object of the present invention is to provide a new fitted top sheet which is susceptible of a low cost of manufacture with regard to both materials and labor, and which accordingly is then susceptible of low prices of sale to the consuming public, thereby making such fitted top sheet economically available to the buying public.

Still yet another object of the present invention is to provide a new fitted top sheet which provides in the apparatuses and methods of the prior art some of the advantages thereof, while simultaneously overcoming some of the disadvantages normally associated there with.

Still another object of the present invention is to provide a new fitted top sheet for holding a top sheet to a mattress in a more secured manner.

Yet another object of the present invention is to provide a new fitted top sheet which includes a top sheet having a first edge, a second edge, a third edge and a fourth edge. The first and second edges are opposite edges with respect to each other. The top sheet has an upper surface and a lower surface and comprises a cloth material. A receiving member removably receives a foot of a mattress. The receiving member is attached to the lower surface of the top sheet and positioned adjacent to the first edge.

Still yet another object of the present invention is to provide a new fitted top sheet that holds a top sheet to a mattress while allowing the edges of the top sheet to hang to provide a cleaner look.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
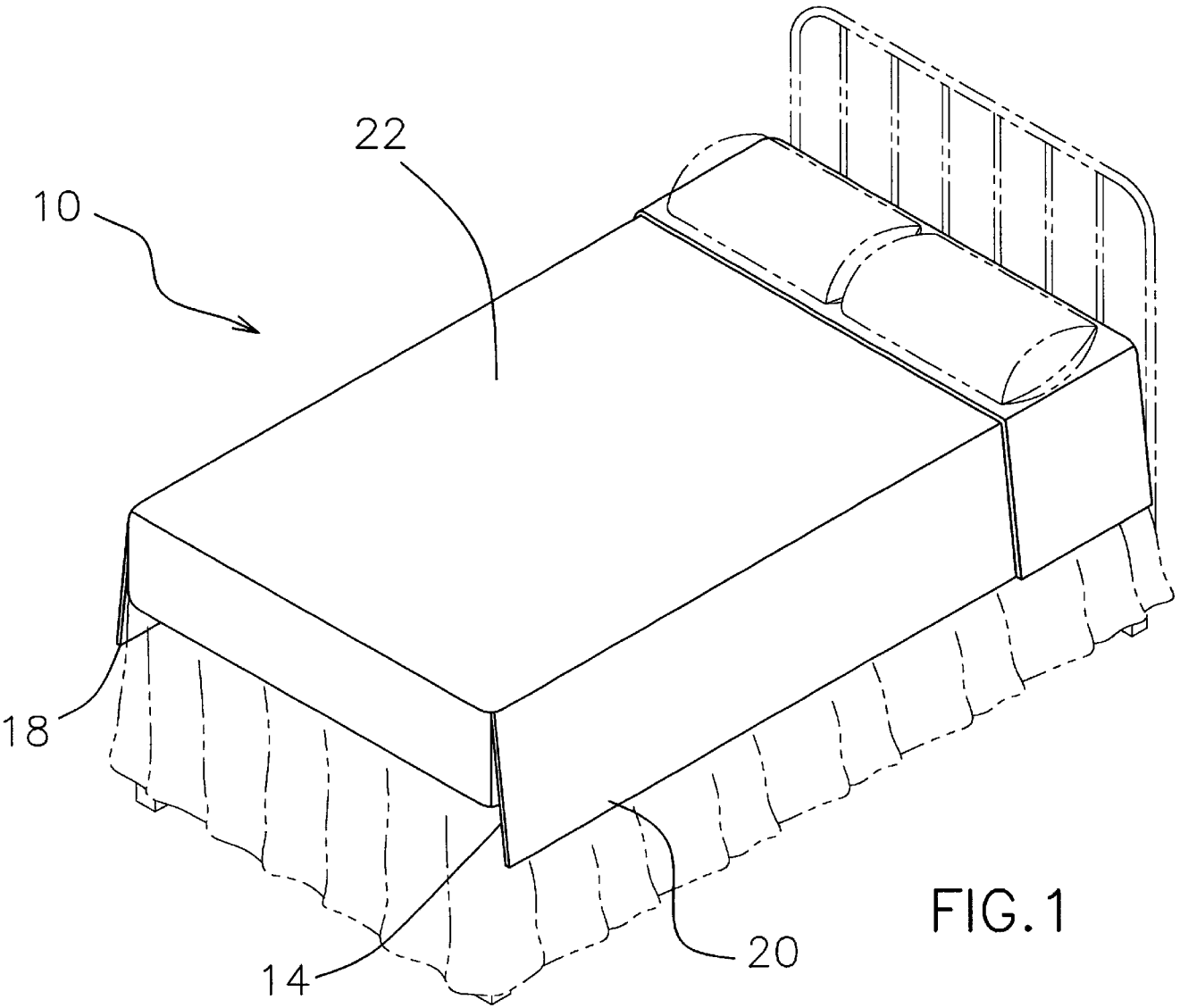
FIG. 1 is a schematic perspective view of a new fitted top sheet according to the present invention.
Figure 2:
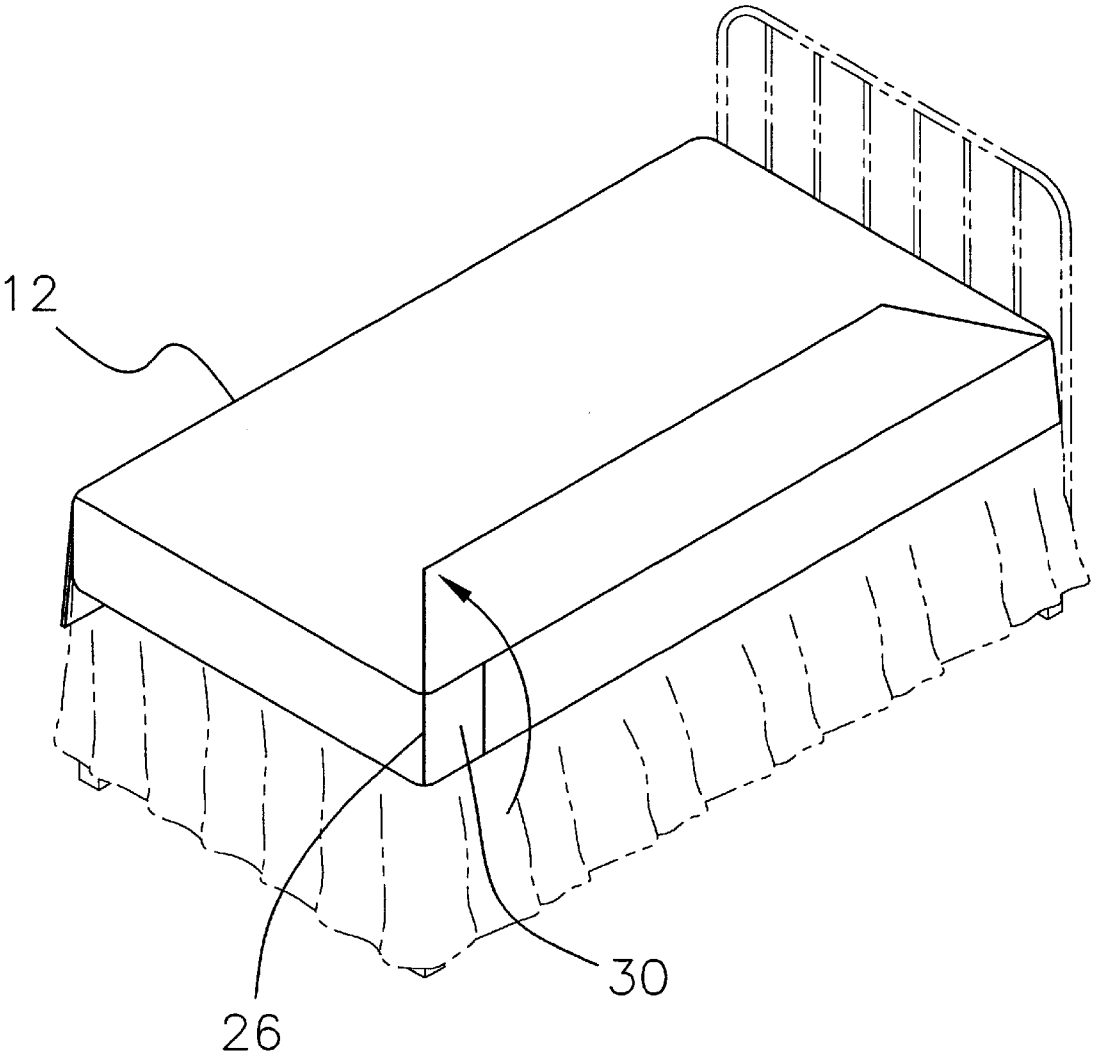
FIG. 2 is a schematic perspective view of the present invention.
Figure 3:
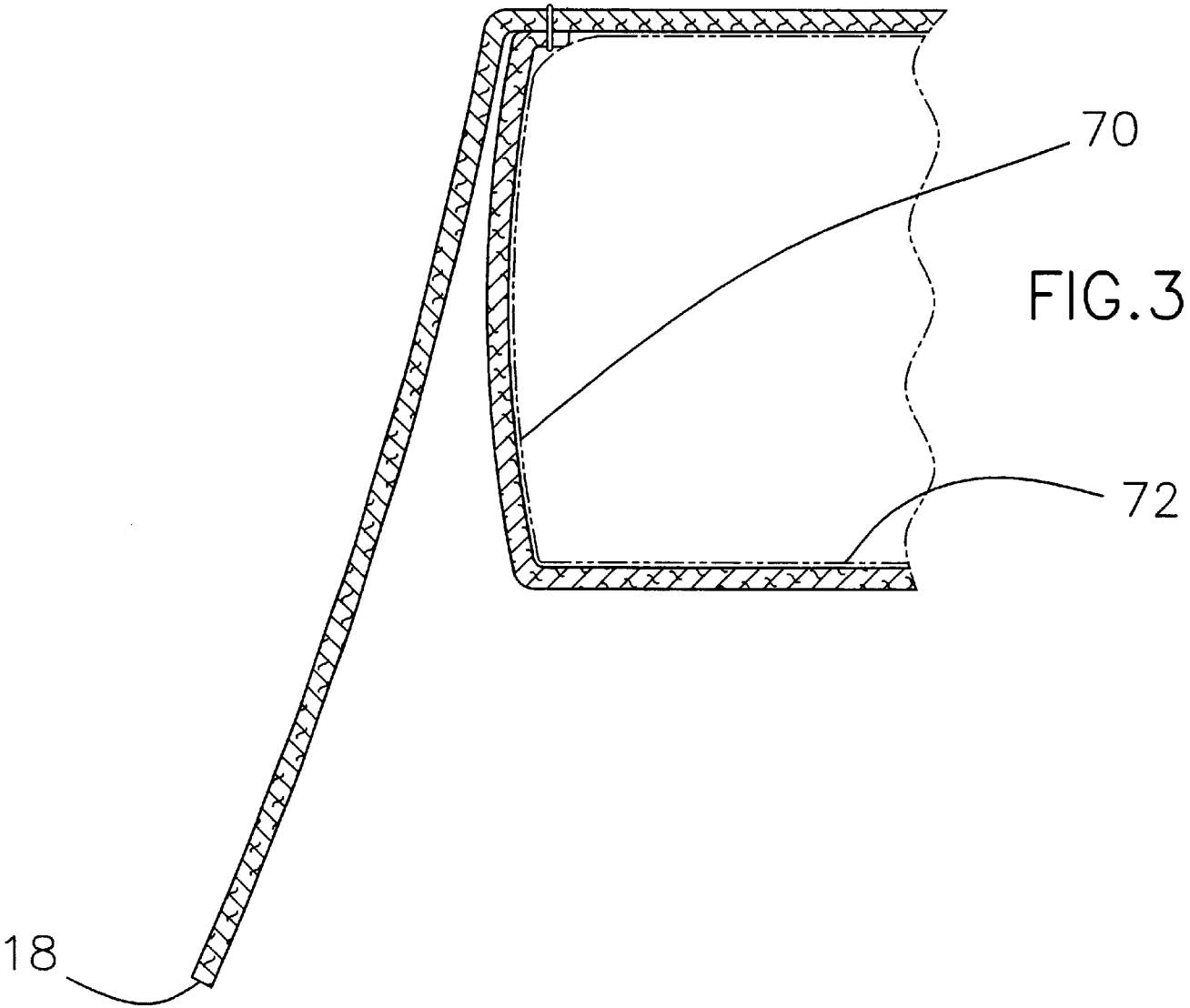
FIG. 3 is a schematic cross-sectional view of the present invention.

With reference now to the drawings, and in particular to FIGS. 1 through 4 thereof, a new fitted top sheet embodying the principles and concepts of the present invention and generally designated by the reference numeral 10 will be described.

As best illustrated in FIGS. 1 through 4, the fitted top sheet 10 generally comprises a device for positioning over the foot 70 of a mattress 72 and comprises a top sheet 12 having a first edge 14, a second edge 16, a third edge 18 and a fourth edge 20. The first 14 and second 16 edges are opposite edges. The top sheet 12 has an upper surface 22 and a lower 24 surface. The top sheet 12 ideally comprises a cloth material.

A receiving member 26 removably receives the foot 70 of the mattress 72 and is attached to the lower surface 24 of the top sheet 12 for removably coupling the receiving member 26 to the mattress 72. The receiving member 26 is positioned adjacent to the first edge 14. The receiving member 26 includes a front panel 28, pair of side panels 30 and a lower panel 32 such that a pouch is defined having an opening 34 facing the second edge 16. The front panel 28 extends along a portion of the first edge 14 between the third 18 and fourth 20 edges. The front panel 28 has a length less than a length of the first edge 14 such that the first edge 14 extends beyond each of the side panels 30. The receiving member 26 comprises a cloth material.

Figure 4:
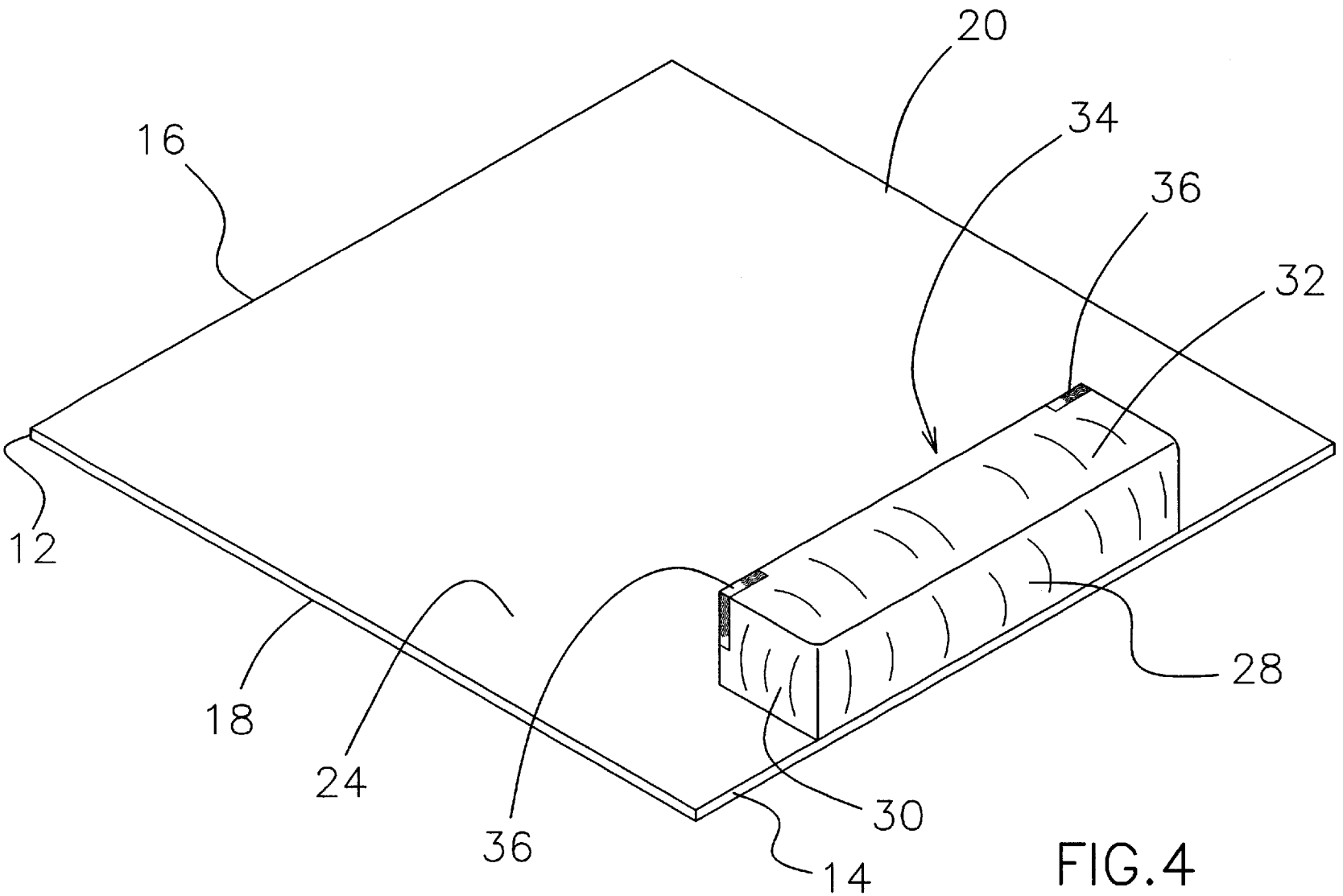
FIG. 4 is a schematic bottom view of the present invention.

Each of a pair of elastic members 36 is attached one of a pair of edges of the receiving member 26 at junctures of the side panels 30 and the lower panel 32. The elastic members 36 aid in coupling the device 10 to the mattress 72. As best seen in FIG. 4, a first elastic member extends along a portion of an edge of the lower panel and the first one of a side panel of the receiving member and a second elastic member extends along a portion of the edge of the lower panel and an edge of the second side panel of the receiving member.

In use, the pouch is positioned over the foot 70 of a mattress 72. The pouch holds the flat sheet 12 so that the flat sheet 12 is not easily pulled away from the mattress 72 when a person uses the bed. The pouch is positioned adjacent to the first edge 14 and has a length less than the first edge 14 so that the third 18 and fourth 20 edges may hang down freely.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fitted top bed sheet for removably positioning over the foot of a mattress comprising:

a top sheet having a first edge, a second edge, a third edge and a fourth edge, said first and second edges being opposite edges, said top sheet having an upper surface and a lower surface, said top sheet comprising a cloth material;

a receiving member for removably receiving the foot of the mattress, said receiving member being attached to said lower surface of said top sheet, said receiving member including a front panel, pair of side panels and a lower panel such that a pouch is defined having an opening facing said second edge, said front panel extends along a portion of said first edge between said third and fourth edges, said front panel having a length less than a length of said first edge such that said first edge extends beyond each of said side panels, said receiving member comprising a cloth material; and a pair of elastic members being attached to each of a pair of edges of said receiving member at junctures of said side panels and said lower panel, a first one of said elastic members extending along a portion of an edge of said lower panel and a first one of said side panels of said receiving member and a second one of said elastic members extending along a portion of the edge of said lower panel and an edge of a second one of said side panels of said receiving member for extending over lower edges of the mattress.

* * * * *